US006786370B1

(12) United States Patent
Kubacki

(10) Patent No.: US 6,786,370 B1
(45) Date of Patent: Sep. 7, 2004

(54) BEADED THIN WALL AEROSOL CONTAINER

(75) Inventor: Edward F. Kubacki, Marengo, IL (US)

(73) Assignee: United States Can Company, Lombard, IL (US)

( * ) Notice: Subject to any disclaimer, the term of this patent is extended or adjusted under 35 U.S.C. 154(b) by 22 days.

(21) Appl. No.: 10/238,286

(22) Filed: Sep. 10, 2002

(51) Int. Cl.[7] ..... B65D 83/14
(52) U.S. Cl. ..... 222/635; 222/1; 222/402.1
(58) Field of Search ..... 222/635, 402.1, 222/1

(56) References Cited

U.S. PATENT DOCUMENTS 5,518,151 A * 5/1996 Knickerbocker ..... 222/382
5,676,512 A 10/1997 Diamond et al.
5,704,513 A 1/1998 Diamond et al.
5,865,337 A 2/1999 Diamond et al.
6,318,583 B1 * 11/2001 Owens ..... 220/672
6,439,430 B1 8/2002 Gilroy, Sr. et al.
6,510,967 B1 * 1/2003 DeSimone ..... 222/402.1

* cited by examiner

*Primary Examiner*—Joseph A. Kaufman
(74) *Attorney, Agent, or Firm*—Polster, Lieder, Woodruff & Lucchesi, L.C.

(57) ABSTRACT

A non-barrier type aerosol container (10) dispensing a fluent material. A generally cylindrical can body (12) has a relatively thin sidewall thickness of between 0.004 inches and 0.010 inches depending upon the type of metal from which the container is made. The can body has beads (30) formed at regular intervals substantially its length. The beading adds structural strength to the container so the container is not readily deformed when un-pressurized. The aerosol container also can withstand a vacuum of at least 23 inches of Mercury without collapsing. A valve assembly (14) includes a spray valve (20) for dispensing the fluent material stored in the container. The container is filled with the fluent material and a propellant stored in the container under pressure.

28 Claims, 2 Drawing Sheets

BEADED THIN WALL AEROSOL CONTAINER

CROSS REFERENCE TO RELATED APPLICATIONS

None

STATEMENT REGARDING FEDERALLY SPONSORED RESEARCH OR DEVELOPMENT

Not applicable

BACKGROUND OF THE INVENTION

This invention relates to aerosol containers, and more particularly to a 2 piece or 3 piece thin walled, non-barrier type aerosol container.

Thin wall, nonbarrier type, aerosol containers are known in the art. See, for example, U.S. Pat. No. 5,211,317 to Diamond et al., and its reissue Re 35,843. It is a feature of containers built in accordance with the teachings of these patents that the sidewall of the container has a relatively thin thickness. In the Diamond et al. patent and its reissue, the container wall thickness is said to be on the order of 0.004–0.005 inches (0.102 mm–0.127 mm).

In un-pressurized containers, it is often possible to distort the sidewall of the container. The Diamond et al. patents, for example, refer to the sidewall being deflected by as much as ¼ inch, if a force of as little as 5–10 pounds is applied to the can prior to filling. Additionally, the can, when empty, is said to be easily crushable by hand pressure. However, the cans can be pressurized in a manner so that at 130° F. (54.4° C.), for example, the pressure does not exceed 120–130 psig. Further, the cans will not burst at one and onehalf times this pressure (180 psig). However, the cans cannot be vacuum filled at a vacuum level greater than 18 inches of Mercury because if they are, the container will collapse.

While there are a number of advantages to a container having thin sidewalls (lower material costs, for example), current thin wall can constructions have drawbacks as well. For example, during handling of the container prior to its being filled, even a moderate amount of force can distort or crush the container. This renders the container unusable and adds to the manufacturing cost. Those skilled in the art will appreciate that moderate amounts of force can be inadvertently applied to the container at any of a number of different points during the handling and manufacture process, even though the process is substantially automated.

It would be advantageous therefore to provide a thin wall aerosol container; however, one which, when unfilled, is not easily distorted and rendered unusable. The container will, when filled, withstand substantial forces without distorting, and meets Department of Transportation (DOT) standards in this regard.

BRIEF SUMMARY OF THE INVENTION

Among the objects of the invention, briefly stated, is a thin wall aerosol container for use in dispensing a fluent material. The container is either of a 2-piece or 3-piece construction, and is either a barrier or non-barrier type container. The container includes a cylindrical can body having a beaded construction. The beading adds significant structural strength to the container and prevents distortion or crushing of the container sidewall when the can is un-pressurized. The container also includes a spray valve assembly for dispensing the fluent material. Because of the increased structural strength created by the beading, the container is not subject to damage during manufacture, while still allowing the manufacturer to realize the savings of a thinner wall construction.

The can is filled both with the fluent material and a propellant. During filling, the container can withstand a vacuum of at least 23 inches of Mercury without collapsing. This allows the can body to be vacuum crimped to the spray valve assembly, simplifying the filling process.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings and which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 1:
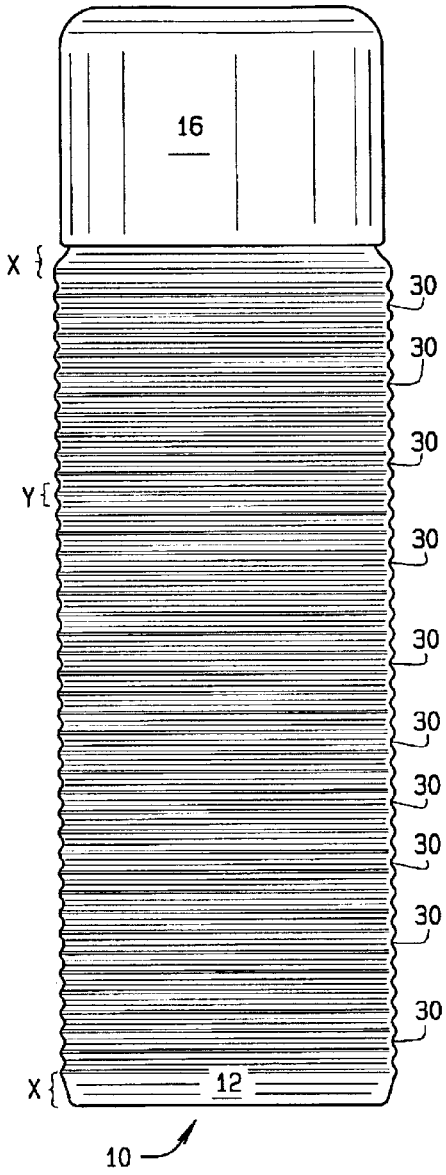
FIG. 1 is an elevation view of a container of the present invention.
Figure 2:
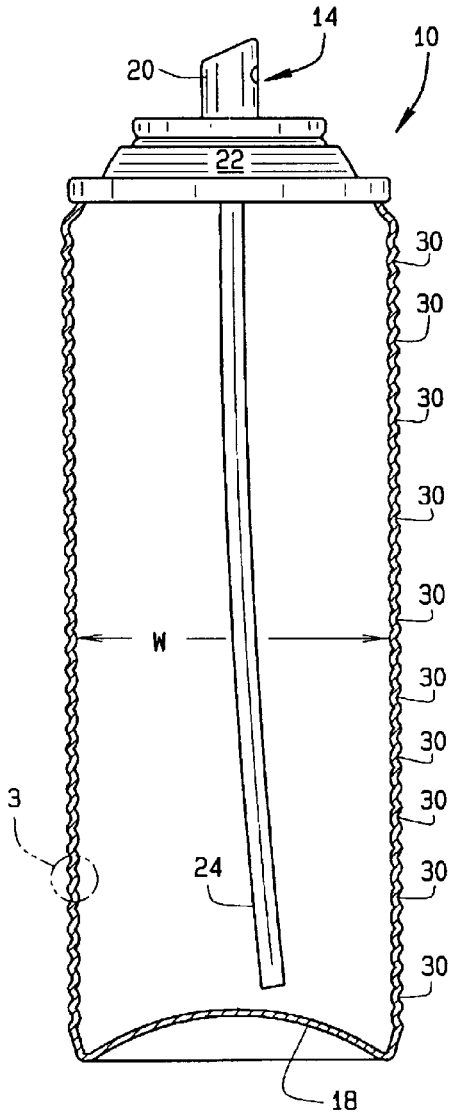
FIG. 2 is a partial sectional view of the container.

Referring to the drawings, an aerosol container of the present invention is indicated generally 10 in FIGS. 1 and 2. In FIG. 2, the container is shown to be a non-barrier type container (that is, it has no wall separating the fluent material discharged from the container with a propellant used for this purpose); although the container could be a barrier type container without departing from the scope of the invention. Container 10 includes a can body 12, a valve assembly 14 for dispensing the fluent material stored in the container, and a cap 16.

Can body 12 comprises a generally cylindrical can body which having a relatively thin sidewall thickness. Preferably, can body 12 is made either of steel or aluminum. If the can body is made of steel, the wall thickness is between 0.004 and 0.008 inches (0.102–0.205 mm). If made of aluminum, the wall thickness is between 0.004 and 0.010 inches (0.1020–0.255 mm). It will be appreciated by those skilled in the art, that aerosol containers are manufactured in standard sizes. Can body 12 is available in all of these standard sizes, and custom size containers can be manufactured as well.

The can body includes a dome shaped base 18 forming the bottom of the can. Base 18 is made of the same material as body 12. In a two-piece container construction, either base 18 or a dome 22 is integrally formed with the can body. In a three-piece container construction, the base and dome are separate pieces which are attached to the respective lower or upper ends of the can body in the conventional manner. Valve assembly 14 includes a spray nozzle 20 of conventional design. The nozzle is mounted in the dome 22 forming the top of the can. A hollow dip tube 24 extends from nozzle 20 down into the lower reaches of the aerosol container as shown in FIG. 2. Fluent material flows through the dip tube to the spray nozzle when discharged from the container. When the container is not in use, cap 16 is fitted over the nozzle portion of the container. The propellant used to dispense the fluent material is a compressed gas for which the container pressure is between 90–140 psig (621–965 kPa) when the container is filled. Alternately, the propellant is a liquefied gas with the container pressure being between 30–50 psia (207–345 kPa) when the container is filled.

Unlike conventional thin wall aerosol containers, can body 12 of container 10 is a beaded can body. Preferably, the can has a series of spaced beads 30 formed at intervals along the length of the can body. As indicated in FIG. 1, the uppermost and lowermost beads are formed a predetermined distance X from the respective top and bottom of the can body. This distance is, for example, 0.75 inches (191 mm) for a two-piece container construction. Next, the beads are spaced so the center of each bead is a predetermined distance Y from the center of the adjacent bead. This distance is, for example, 0.125 inches (31.8 mm). The spacing is uniform along the length of the can. Each bead extends circumferentially about the can body and has a maximum depth or inward depression of Z which occurs substantially at the center of the bead. Depth Z is, for example, 0.021 inches (5.3 mm). As described herein, forming beads at spaced intervals substantially along the entire length of container body adds significant structural strength to the container. As a result, the container is not readily deformed when in its un-pressurized state prior to being filled.

In fabricating the beads, they are made such that the outer surface of the can body has substantially the same outer diameter (O.D.) as the can body for a standard, nonbeaded container. The minimum diameter of the can, indicated W in FIG. 2 is given by the formula $$\text{Minimum diameter}=O.D.-2Z$$

That is, the outer diameter of the can body minus twice the depth of a bead.

To determine the strength or rigidity of the can in its un-pressurized condition, containers made in accordance with the above dimensions were subjected to a series of tests. It was found that when subjected to a force in excess of 10 lbs, there was little deflection in the sidewall of the can. During testing, it was found, for example, that an applied force of 13.7 pounds to the sidewall of the container produced a deflection of 0.098 inches (0.25 cm). Further, the can, when empty, was not easily crushed by hand. This is important because besides the cost savings realized by having a container requiring less material to fabricate than conventional, thicker walled containers, the beaded thin wall container of the present invention is not susceptible to damage during manufacturing operations performed prior to filling the container.

Figure 3:
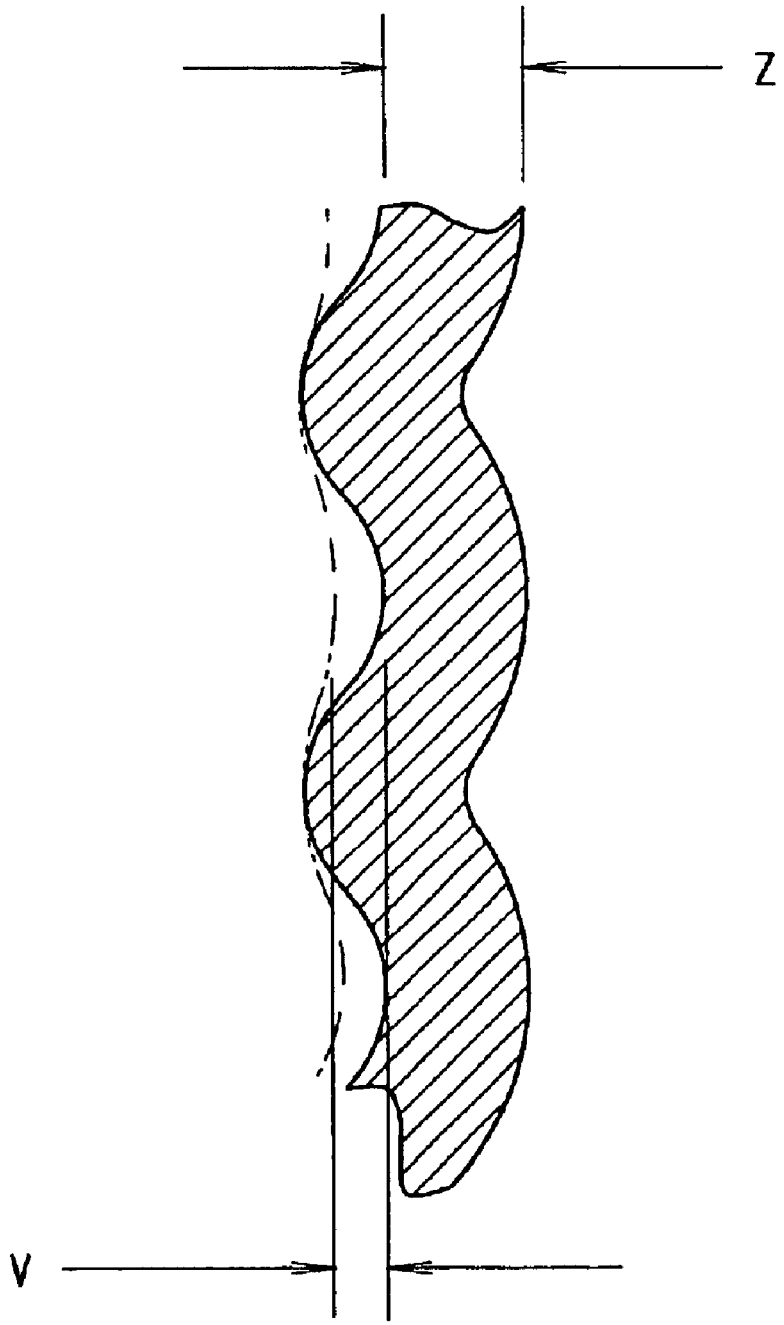
FIG. 3 is an enlarged partial sectional view of the sidewall of the container body illustrating the amount of deflection that occurs when the container is subjected to pressure.

The fluent material dispensed by aerosol container 10, and the propellant used for this purpose, are stored in the container under pressure. A two-piece aerosol container was constructed in accordance with the dimensions set forth above. During filling, it was found that the container could withstand a vacuum of at least 23 inches of Mercury without collapsing. In pressurization tests, container 10 was subjected to pressures ranging from 0–90 psi. Tests were then performed to measure how much the container expanded (both longitudinally, and diametrically). It will be appreciated, that as shown in FIG. 3, the internal pressure pushes outwardly on the container sidewall which tends to flatten the sidewall. For tests performed on a standard container of 202 size, the maximum distortion measured (indicated V in FIG. 3) was less than 0.0013 inches (0.33 mm).

What has been described is a thin wall aerosol container having a beaded sidewall construction. The beading adds sufficient strength to the container so that when unpressurized, the can body is not readily distorted or crushed. This makes it less susceptible to damage during those manufacturing processes performed prior to filling the container. Further, when pressurized, the expansion of the can's sidewalls is minimal even at higher pressures. The container, when filled, can withstand vacuum levels in excess of 23 inches of Mercury without collapsing. When filled, the container will withstand extremely high internal pressures without bursting. Finally, aerosol containers made in accordance with the invention satisfy DOT regulations with respect to their ability not to distort when subjected to specified pressures at specified temperatures.

In view of the above, it will be seen that the several objects and advantages of the present invention have been achieved and other advantageous results have been obtained.

Having thus described the invention, what is claimed and desired to be secured by Letters Patent is:

1. A non-barrier type aerosol container for dispensing a fluent material comprising:

a generally cylindrical can body having a relatively thin sidewall thickness, the can body being a beaded can body having beads formed substantially the entire length thereof from one end of the container to the other with the beading adding structural strength to the container so the container is not readily deformed when subjected to a vacuum during filling with the fluent material, or other external forces; and, a valve assembly for dispensing the fluent material stored in the container, the container being filled with the fluent material and a propellant therefore, the fluent material and propellant being stored in the container under pressure.

2. The aerosol container of claim 1 wherein the valve assembly includes a spray valve for dispensing the fluent material, the valve assembly being attached to the can body at one end thereof.

3. The aerosol container of claim 2 further including a base attached to the other end of the can body.

4. The aerosol container of claim 1 which can withstand a vacuum of at least 23 inches of Mercury without collapsing.

5. The aerosol container of claim 1 in which the can body is made of steel and has a sidewall thickness of between 0.004 inches (0.102 mm) and 0.008 inches (0.205 mm).

6. The aerosol container of claim 1 in which the can body is made of aluminum and has a sidewall thickness of between 0.004 inches (0.102 mm) and 0.010 inches (0.255 mm).

7. The aerosol container of claim 4 in which the propellant is a compressed gas and the container pressure is between 90–140 psig (621–965 kPa) when filled.

8. The aerosol container of claim 4 in which the propellant is a liquefied gas and the container pressure is between 30–50 psig (207–345 kPa) when filled.

9. The aerosol container of claim 1 in which the beads are uniformly shaped beads and uniformly spaced along the length of the can body.

10. The aerosol container of claim 9 in which the uppermost bead formed in the can body and the lowermost bead formed therein are each formed the same predetermined distance from the respective upper and lower ends of the can body.

11. The aerosol container of claim 1 in which the depth of each bead is approximately one-sixth the distance between the center of adjacent beads.

12. A non-barrier type aerosol container for dispensing a fluent material comprising:

a generally cylindrical can body made of steel and having a sidewall thickness of between 0.004 inches (0.102 mm) and 0.008 inches (0.205 mm), the can body being a beaded can body having beads formed substantially along the entire length of the can body from one end of the container to the other, the beading adding structural strength to the container so the container is not readily deformed when subjected to vacuum during filling with the fluent material, or other external forces; and, a valve assembly for dispensing the fluent material stored in the container, the container being filled with the fluent material and a propellant therefore which are stored in the container under pressure.

13. The aerosol container of claim 12 which can withstand a vacuum of at least 23 inches of Mercury without collapsing.

14. The aerosol container of claim 13 in which the propellant is a compressed gas and the container pressure is between 90–140 psig (621–965 kPa) when filled.

15. The aerosol container of claim 13 in which the propellant is a liquefied gas and the container pressure is between 30–50 psig (207–345 kPa) when filled.

16. The aerosol container of claim 12 in which the beads are uniformly spaced beads with the uppermost bead formed in the can body and the lowermost bead formed therein after each being formed the same predetermined distance from the respective upper and lower ends of the can body.

17. A non-barrier type aerosol container for dispensing a fluent material comprising:

a generally cylindrical can body made of aluminum and having a sidewall thickness of between 0.004 inches (0.102 mm) and 0.010 inches (0.255 mm), the can body being a beaded can body having beads formed substantially along the entire length of the can body from one end of the container to the other, the beading adding structural strength to the container so the container is not readily deformed when subjected to a vacuum during filling with the fluent material or other external forces; and, a valve assembly for dispensing the fluent material stored in the container, the container being filled with the fluent material and a propellant therefore which are stored in the container under pressure.

18. The aerosol container of claim 17 which can withstand a vacuum of at least 23 inches of Mercury without collapsing.

19. The aerosol container of claim 17 in which the propellant is a compressed gas and the container pressure is between 90–140 psig (621–965 kPa) when filled.

20. The aerosol container of claim 17 in which the propellant is a liquefied gas and the container pressure is between 30–50 psig (207–345 kPa) when filled.

21. The aerosol container of claim 17 in which the beads are uniformly spaced along the length of the can body with the uppermost bead formed in the can body and the lowermost bead formed therein being formed the same predetermined distance from the respective upper and lower ends of the can body.

22. A process for dispensing a fluent material from an aerosol container comprising:

forming an aerosol container having a generally cylindrical can body of a relatively thin sidewall thickness, the can body being a beaded can body having beads formed substantially the entire length of the can body from one end of the container to the other, the beads adding structural strength to the container so the container does not readily deform when subjected to a vacuum or external forces;

fitting a valve assembly to one end of the can body, the other end of the can body being closed, the valve assembly including a spray valve for dispensing the fluent material; and, filling the container with the fluent material and a propellant for dispensing the fluent material, the fluent material and propellant being stored in the container under pressure.

23. The process of claim 22 in which the propellant is a compressed gas and the container pressure is 90–140 psig when the container is filled.

24. The process of claim 22 in which the propellant is a liquefied gas and the container pressure is between 30–50 psig (207–345 kPa) when the container is filled.

25. The process of claim 22 in which the can body is made of steel and has a sidewall thickness of between 0.004 inches (0.102 mm) and 0.008 inches (0.205 mm).

26. The process of claim 22 in which the can body is made of aluminum and has a sidewall thickness of between 0.004 inches (0.102 mm) and 0.010 inches (0.255 mm).

27. The process of claim 22 in which the aerosol container can withstand a vacuum of at least 23 inches of Mercury without collapsing.

28. The process of claim 22 in which the beads are uniformly spaced along the length of the can body with the uppermost bead formed in the can body and the lowermost bead formed therein each being formed the same predetermined distance from the respective upper and lower ends of the can body.

* * * * *